US012630333B2

(12) United States Patent
Li

(10) Patent No.: US 12,630,333 B2
(45) Date of Patent: May 19, 2026

(54) STACKED CLAY BOX

(71) Applicant: Ningbo Miro Toys Co., Ltd., Ningbo (CN)

(72) Inventor: Rui Li, Ningbo (CN)

( * ) Notice: Subject to any disclaimer, the term of this patent is extended or adjusted under 35 U.S.C. 154(b) by 20 days.

(21) Appl. No.: 19/271,545

(22) Filed: Jul. 16, 2025

(65) Prior Publication Data

US 2026/0021934 A1 Jan. 22, 2026

(30) Foreign Application Priority Data

Jul. 18, 2024 (CN) ..... 202421710076.9

(51) Int. Cl.

| | |
|---|---|
| ***B65D 21/02*** | (2006.01) |
| ***B65D 25/04*** | (2006.01) |
| ***B65D 25/28*** | (2006.01) |
| ***B65D 43/02*** | (2006.01) |
| ***B65D 45/18*** | (2006.01) |

(52) U.S. Cl.

CPC ..... *B65D 21/0213* (2013.01); *B65D 25/04* (2013.01); *B65D 43/0222* (2013.01); *B65D 45/18* (2013.01); *B65D 25/2841* (2013.01); *B65D 2585/54* (2013.01)

(58) Field of Classification Search

CPC ..... B65D 21/0213; B65D 25/04; B65D 43/0222; B65D 45/18

USPC ..... 206/503

See application file for complete search history.

(56) References Cited

U.S. PATENT DOCUMENTS 7,439,056 B2 * 10/2008 Duffy ..... G01N 33/54366 435/287.8

10,889,406 B2 * 1/2021 Oskarsson ..... B65D 21/0215

FOREIGN PATENT DOCUMENTS

CN 118953849 A 11/2024

CN 222523062 U 2/2025

* cited by examiner

*Primary Examiner* — Sue A Weaver

(74) *Attorney, Agent, or Firm* — Nitin Kaushik

(57) ABSTRACT

This disclosure relates to the field of clay placement boxes, and in particular, to a stacked clay box. The stacked clay box includes at least one housing assembly, where the housing assembly includes a bottom housing, the bottom housing is provided with a first opening and a first cavity, and the plurality of bottom housings are arranged to be stacked up and down; and a cover plate, where the cover plate is arranged at the top of the bottom housing, the housing assembly further includes two rotating plates, and the two rotating plates are rotatably connected to the bottom housing. This disclosure can achieve the advantages of being able to store a variety of clays, being convenient to place the housing assembly, having a reasonable layout, and having high practicability.

7 Claims, 10 Drawing Sheets

STACKED CLAY BOX

CROSS-REFERENCE TO RELATED APPLICATIONS

The application claims priority to Chinese patent application No. 2024217100769, filed on Jul. 18, 2024, the entire contents of which are incorporated herein by reference.

TECHNICAL FIELD

This disclosure relates to the field of clay placement boxes, and in particular, to a stacked clay box.

BACKGROUND

Currently, most clay boxes on the market are sold as a single unit, for example, the Chinese patent application No. CN202220890239.0, entitled "CLAY PACKAGING BOX WITH LOCK CATCH". The clay packaging box includes a box body and a box cover, where an upper end of the box body is provided with an edge portion extending towards the periphery, the box cover and the edge portion are matched to cover the box body, the box cover and the edge portion are correspondingly provided with at least two vertically-through through holes, a locking pin is inserted into the through hole, a lower portion of the locking pin is provided with a side edge, an inner wall of the through hole is provided with a sliding groove allowing the side edge to pass through, limiting teeth are arranged below the edge portion, and the side edge can extend out of the sliding groove and is clamped at the limiting teeth after being rotated. An upper portion of the locking pin is sleeved with the lock strip, an upper edge and a lower edge of the lock strip are connected with the locking pin through a thin and soft portion, the thin and soft portion is easy to break, and the clay packaging box is simple in structure and good in safety. However, according to the above solution, due to the limitation of the size of the box body, a large amount of clay cannot be stored, resulting in fewer types of clay in the box body; and if a user needs more types of clay, another box body needs to be purchased, and the structural design described above cannot be stacked, resulting in a relatively troublesome placement.

Therefore, there is a need to provide a stacked clay box which is capable of storing a variety of clays, convenient to place the housing assembly, reasonable in layout and high in practicability.

SUMMARY

The main purpose of this disclosure is to provide a stacked clay box, where the stacked clay box can effectively use its own structural configuration to achieve the advantages of being able to store a variety of clays and being convenient to place the housing assembly.

Another purpose of this disclosure is to provide a stacked clay box, where the stacked clay box includes at least one housing assembly and a cover plate. The housing assembly includes a bottom housing, and the bottom housing is provided with a first opening and a first cavity. The first opening is in communication with the first cavity, and the plurality of bottom housings are arranged to be stacked up and down. The cover plate is arranged at the top of the bottom housing to close the first opening, and the housing assembly further includes two rotating plates. The two rotating plates are located on two sides of the bottom housing and are rotatably connected to the bottom housing, and the two rotating plates can swing in a direction close to each other by a preset angle, allowing the two rotating plates to be further connected to two sides of the cover plate in a clamped manner. A variety of clays can be placed on the bottom housing. In addition, a variety of clays are placed in a manner of stacking a plurality of bottom housings up and down, thereby having a higher market competitiveness and saving space in an up-down stacking manner.

Another purpose of this disclosure is to provide a stacked clay box, where the stacked clay box is simple in structure and convenient to operate, does not involve a complicated manufacturing process and an expensive material, has high economy, and is easy to popularize and use.

To achieve at least one of the above purposes, this disclosure provides a stacked clay box, including:

at least one housing assembly, where the housing assembly includes a bottom housing, the bottom housing is provided with a first opening and a first cavity, the first opening is in communication with the first cavity, and the plurality of bottom housings are arranged to be stacked up and down;

and a cover plate, where the cover plate is arranged at the top of the bottom housing to close the first opening, the housing assembly further includes two rotating plates, the two rotating plates are located on two sides of the bottom housing and are rotatably connected to the bottom housing, and the two rotating plates can swing in a direction close to each other by a preset angle, allowing the two rotating plates to be further connected to two sides of the cover plate in a clamped manner.

In one or more embodiments of this disclosure, a bottom wall forming the first cavity is further provided with a partition plate, the partition plate separates the first cavity into two placement cavities, and the two placement cavities are both in communication with the first opening.

In one or more embodiments of this disclosure, one side of the bottom housing is provided with two first protruding portions arranged oppositely and a first clamping plate, the first clamping plate is located on lower sides of the two first protruding portions, the other side of the bottom housing is provided with two second protruding portions arranged oppositely and a second clamping plate, the second clamping plate is located on lower sides of the two second protruding portions, the bottom of one of the rotating plates is rotatably connected to the two first protruding portions, the bottom of the other rotating plate is rotatably connected to the two second protruding portions, and the tops of the two rotating plates can swing towards an end close to each other by a preset angle, allowing the tops of the two rotating plates to be matched with the third clamping plate and the fourth clamping plate, respectively.

In one or more embodiments of this disclosure, a side wall forming the placement cavity is stepped, a placement plate is arranged in the placement cavity, the placement plate abuts against a step surface forming the placement cavity, the placement plate is further provided with a plurality of placement grooves which are distributed uniformly and arranged at intervals, and the placement grooves are in communication with the placement cavity.

In one or more embodiments of this disclosure, each of the placement grooves is provided with a second housing, the bottom of the second housing penetrates through the placement groove and is in contact with a bottom wall forming the placement groove, and meanwhile the top of the second housing is placed in the placement groove.

In one or more embodiments of this disclosure, the top of the second housing is provided with a cover body, the cover body is buckled at the top of the second housing, one side of the cover body is further provided with an extension end, a middle section of the extension end is provided with a clamping portion, the placement plate is further provided with a plurality of limiting grooves which are distributed uniformly and arranged at intervals, the plurality of limiting grooves are in one-to-one correspondence with the plurality of placement grooves, the extension end penetrates through the limiting groove, and meanwhile the clamping portion abuts against the bottom of the placement plate.

In one or more embodiments of this disclosure, one side, close to the bottom housing, of the cover plate is further provided with a plurality of clamping blocks arranged at intervals, and the plurality of clamping blocks are configured to clamp a clay tool.

BRIEF DESCRIPTION OF THE DRAWINGS

The advantages of these and/or other aspects of this disclosure will become clearer and easier to understand from the following detailed description of embodiments of this disclosure with reference to the accompanying drawings, in which.

DETAILED DESCRIPTION OF THE EMBODIMENTS

The terms and words used in the following specification and claims are not limited to the literal meaning, but are only used by the inventors to enable a clear and consistent understanding of this disclosure. Therefore, it is obvious to those skilled in the art that the following description of various embodiments of this disclosure is provided for the purpose of illustration only and not for the purpose of limiting this disclosure as defined by the appended claims and their equivalents.

It can be understood that the term "a" should be understood as "at least one" or "one or more", that is, in one embodiment, there may be one element, and in other embodiments, there may be a plurality of elements, and the term "a" cannot be understood as a limitation on the number.

Although ordinal numbers such as "first", "second" and the like will be used to describe various assemblies, those assemblies are not limited herein. The term is only used to distinguish one assembly from another assembly. For example, a first assembly may be referred to as a second assembly, and similarly, a second assembly may be referred to as a first assembly, without departing from the teachings of the inventive concept. The term "and/or" as used herein includes any and all combinations of one or more of the relevant listed items.

The term used herein is for the purpose of describing various embodiments only and is not intended to be limiting. As used herein, the singular forms are also intended to include plural forms unless the context clearly indicates otherwise. In addition, it should be understood that the terms "comprising" and/or "having" when used in this specification specify the presence of the stated features, numbers, steps, operations, components, elements, or combinations thereof, without excluding the presence or addition of one or more other features, numbers, steps, operations, components, elements, or combinations thereof.

Figure 1:
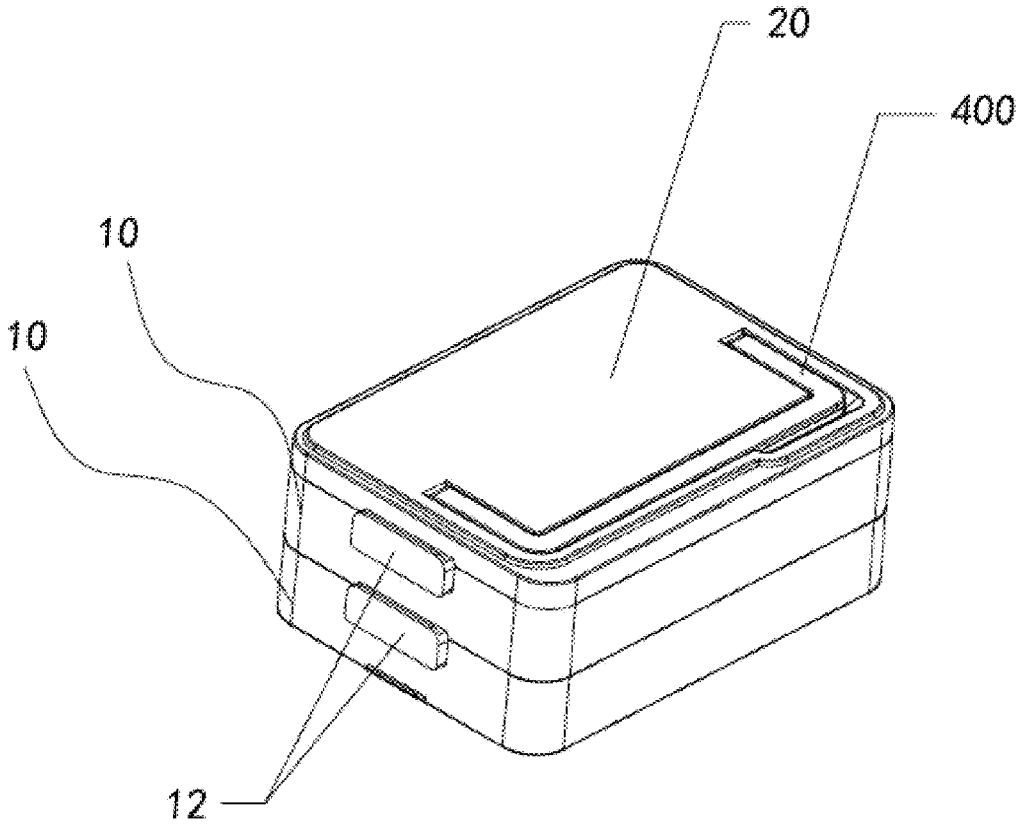
FIG. 1 shows a stacked schematic view of a stacked clay box.
Figure 2:
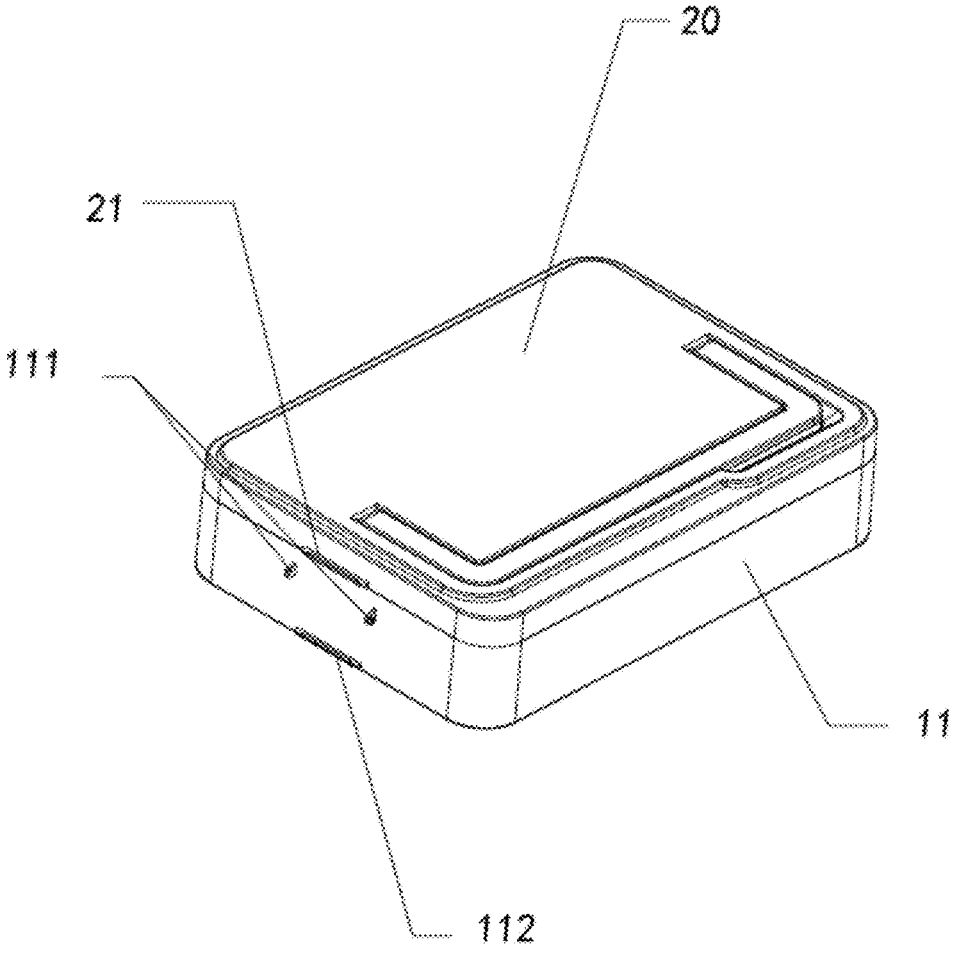
FIG. 2 shows a schematic structural diagram 1 of a stacked clay box.
Figure 3:
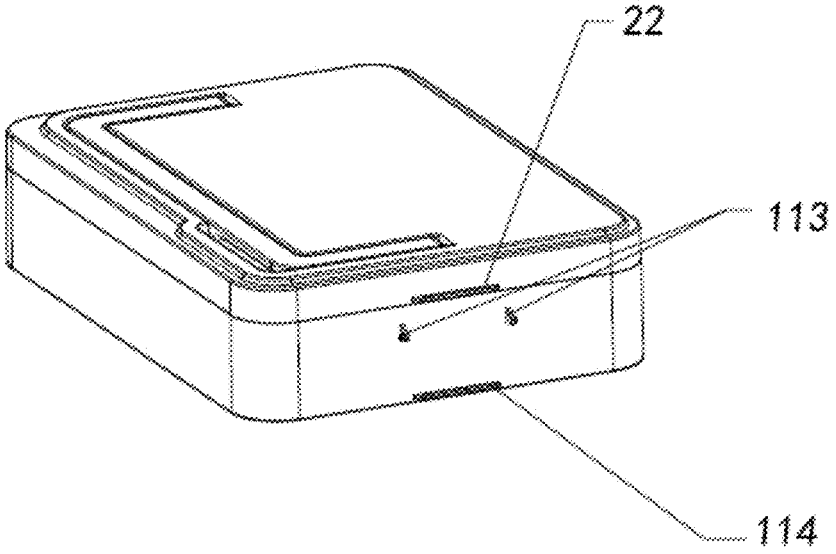
FIG. 3 shows a schematic structural diagram 2 of a stacked clay box.
Figure 4:
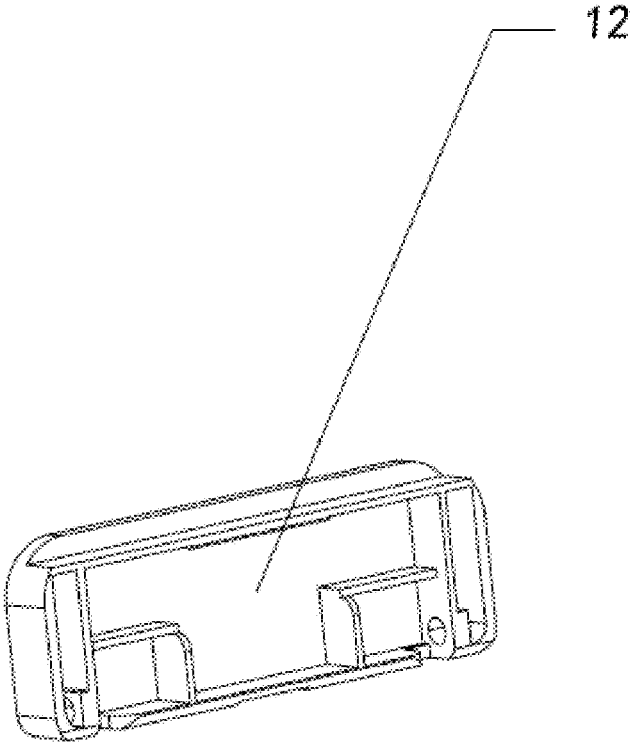
FIG. 4 shows a schematic structural diagram of a rotating plate.
Figure 5:
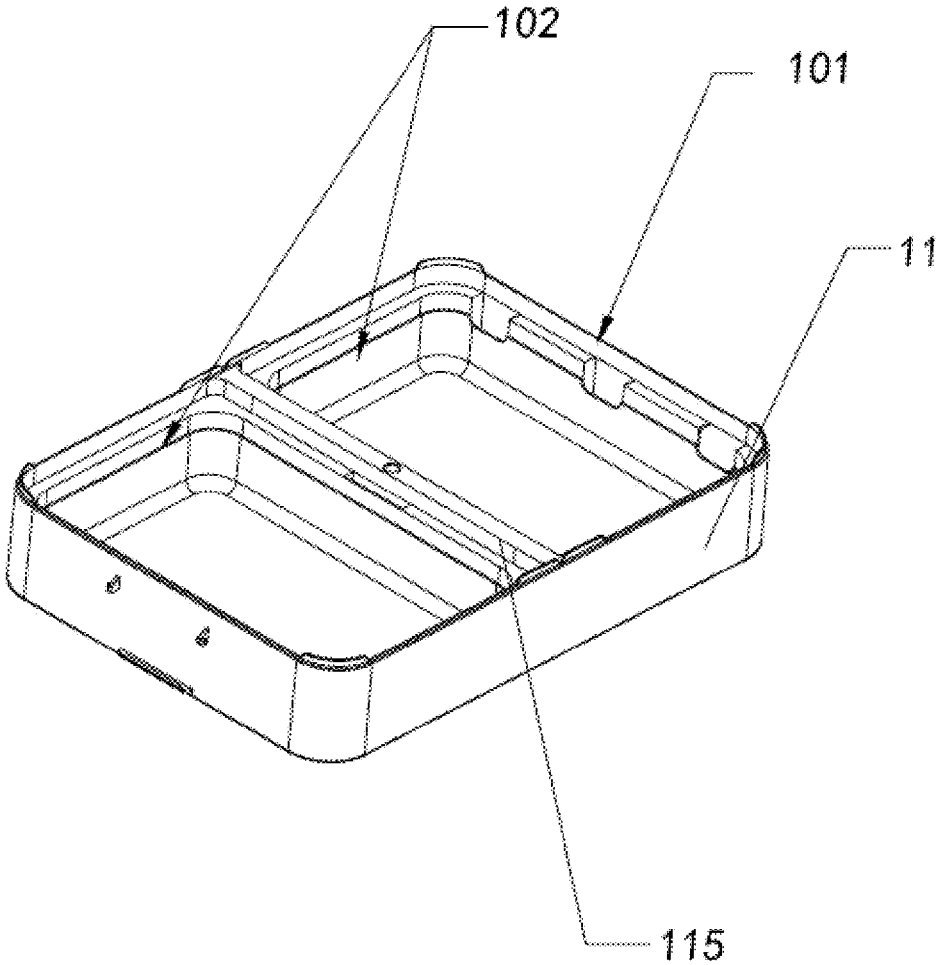
FIG. 5 shows a schematic structural diagram of a bottom housing.

An exemplary stacked clay box, referring to FIG. 1 to FIG. 10, a stacked clay box according to a preferred embodiment of this disclosure. It should be noted that a structure of the stacked clay box is shown in FIG. 1. It should be noted that, the stacked clay box includes at least one housing assembly 10, where the housing assembly 10 includes a bottom housing 11, the bottom housing 11 is provided with a first opening 101 and a first cavity, and the first opening 101 is in communication with the first cavity. It should be noted that, in this disclosure, a plurality of bottom housings 11 can be arranged and combined together in an up-down stacking manner.

Specifically, a bottom wall forming the first cavity is further provided with a partition plate 115, the partition plate 115 separates the first cavity into two placement cavities 102, and the two placement cavities 102 are both in communication with the first opening 101.

Further, one side of the bottom housing 11 is provided with two first protruding portions 111 arranged oppositely and a first clamping plate 112, and the first clamping plate 112 is located on lower sides of the two first protruding portions 111. In addition, the other side of the bottom housing 11 is provided with two second protruding portions 113 arranged oppositely and a second clamping plate 114, and the second clamping plate 114 is located on lower sides of the two second protruding portions 113. Specifically, the two first protruding portions 111 and the two second protruding portions 113 are both close to the top of the bottom housing 11, and the first clamping plate 112 and the second clamping plate 114 are both located at the bottom of the bottom housing 11.

Specifically, the stacked clay box further includes a cover plate 20, and the cover plate 20 is arranged at the top of the bottom housing 11 to close the first opening 101. Specifically, one side of the cover plate 20 is provided with a third clamping plate 21, and the other side of the cover plate is provided with a fourth clamping plate 22. The third clamping plate 21 directly faces the first clamping plate 112, and the fourth clamping plate 22 directly faces the second clamping plate 114. In addition, each of the housing assemblies 10 includes two rotating plates 12. The bottom of one of the rotating plates 12 is rotatably connected to the two first protruding portions 111, and the bottom of the other rotating plate 12 is rotatably connected to the two second protruding portions 113. Specifically, the tops of the two rotating plates 12 can swing towards an end close to each other by a preset angle, allowing the tops of the two rotating plates 12 to be matched with the third clamping plate 21 and the fourth clamping plate 22, respectively, so that the cover plate 20 can be buckled at the top of the bottom housing 11, and a position of the bottom housing 11 is defined. Oppositely, a user can manually toggle the two rotating plates 12, allowing the two rotating plates 12 to swing in a direction away from each other by a preset angle, so that the two rotating plates 12 are no longer matched with the third clamping plate 21 and the fourth clamping plate 22, and the user can open the cover plate 20. In addition, those skilled in the art should understand that the bottom of the above housing assembly 10 is further provided with at least one housing assembly 10, and the structure is specifically shown in FIG. 1, that is, the two housing assemblies 10 are stacked up and down. Meanwhile, two rotating plates 12 of the other housing assembly 10 are matched with the first clamping plate 112 and the second clamping plate 114 of the first housing, so that the two bottom housings 11 are spliced together, that is, the user can adjust the number of housing assemblies 10 as needed.

Specifically, a side wall forming the placement cavity 102 is stepped, a placement plate 13 is arranged in the placement cavity 102, the placement plate 13 abuts against a step surface forming the placement cavity 102, the placement plate 13 is further provided with a plurality of placement grooves 1301 which are distributed uniformly and arranged at intervals, and the placement grooves 1301 are in communication with the placement cavity 102. In addition, each of the placement grooves 1301 is provided with a second housing 14, the bottom of the second housing 14 penetrates through the placement groove 1301 and is in contact with a bottom wall forming the placement groove 1301, and meanwhile the top of the second housing 14 is placed in the placement groove 1301. That is, a position of the second housing 14 is defined by a wall surface forming the placement groove 1301, and it should be noted that the second housing 14 has a second cavity for storing clay.

Specifically, the top of the second housing 14 is provided with a cover body 15, the cover body 15 is buckled at the top of the second housing 14, one side of the cover body 15 is further provided with an extension end 151, a middle section of the extension end 151 is provided with a clamping portion 152, the placement plate 13 is further provided with a plurality of limiting grooves 1302 which are distributed uniformly and arranged at intervals, the plurality of limiting grooves 1302 are in one-to-one correspondence with the plurality of placement grooves 1301, the extension end 151 penetrates through the limiting groove 1302, and meanwhile the clamping portion 152 abuts against the bottom of the placement plate 13. Specifically, the cover body 15 can be a rubber member. Therefore, the clamping portion 152 can penetrate through the placement groove 1301 in an extrusion deformation manner.

Figure 6:
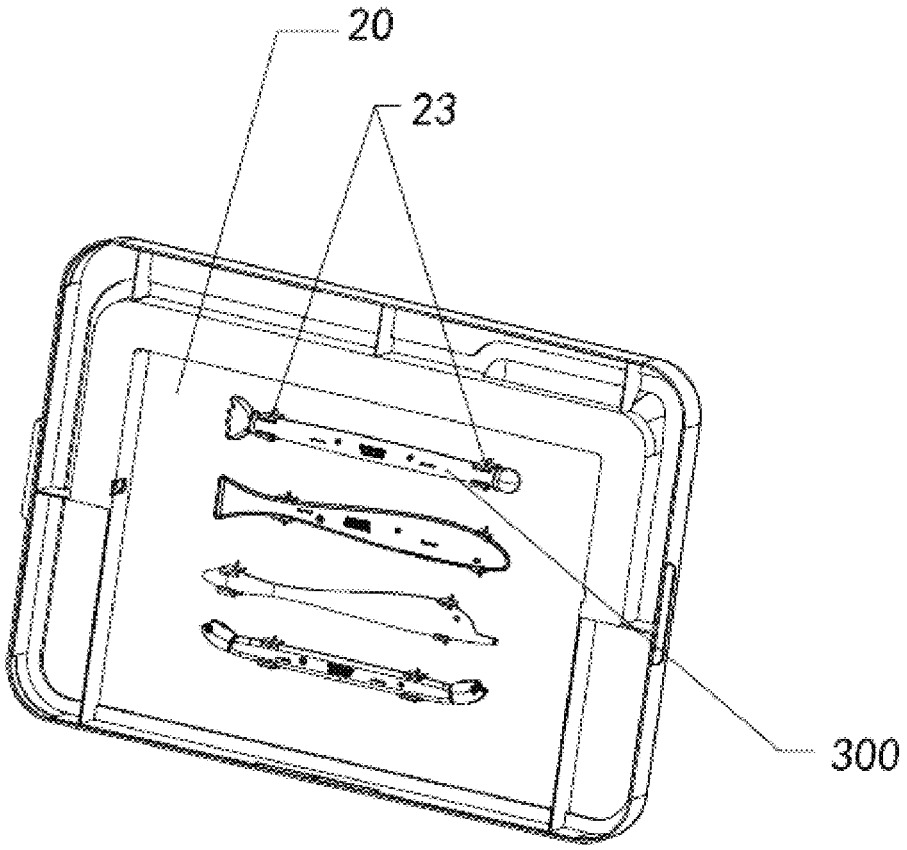
FIG. 6 shows a schematic structural diagram of a cover plate.
Figure 7:
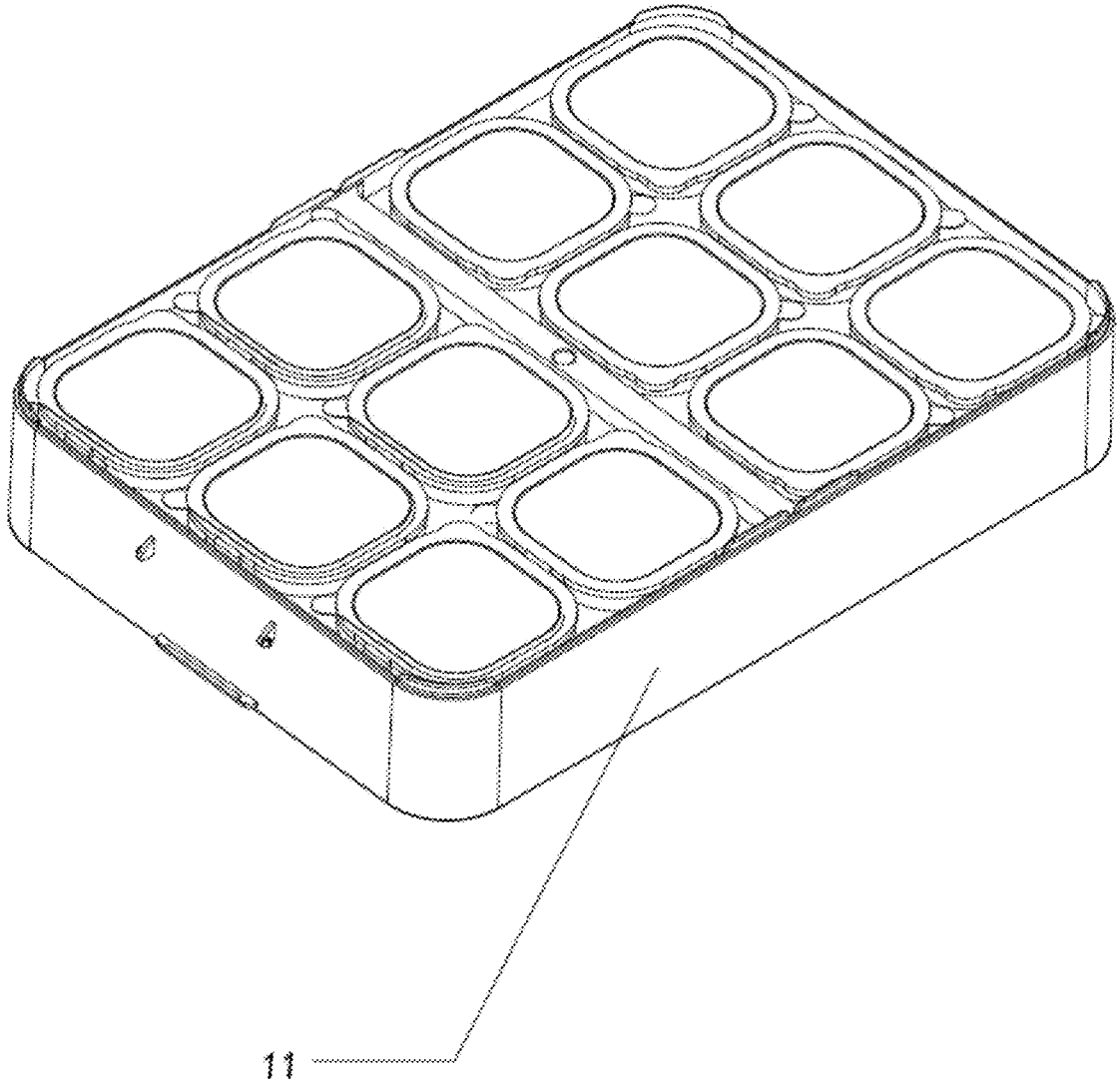
FIG. 7 shows a schematic diagram of a partial structure of a stacked clay box.
Figure 8:
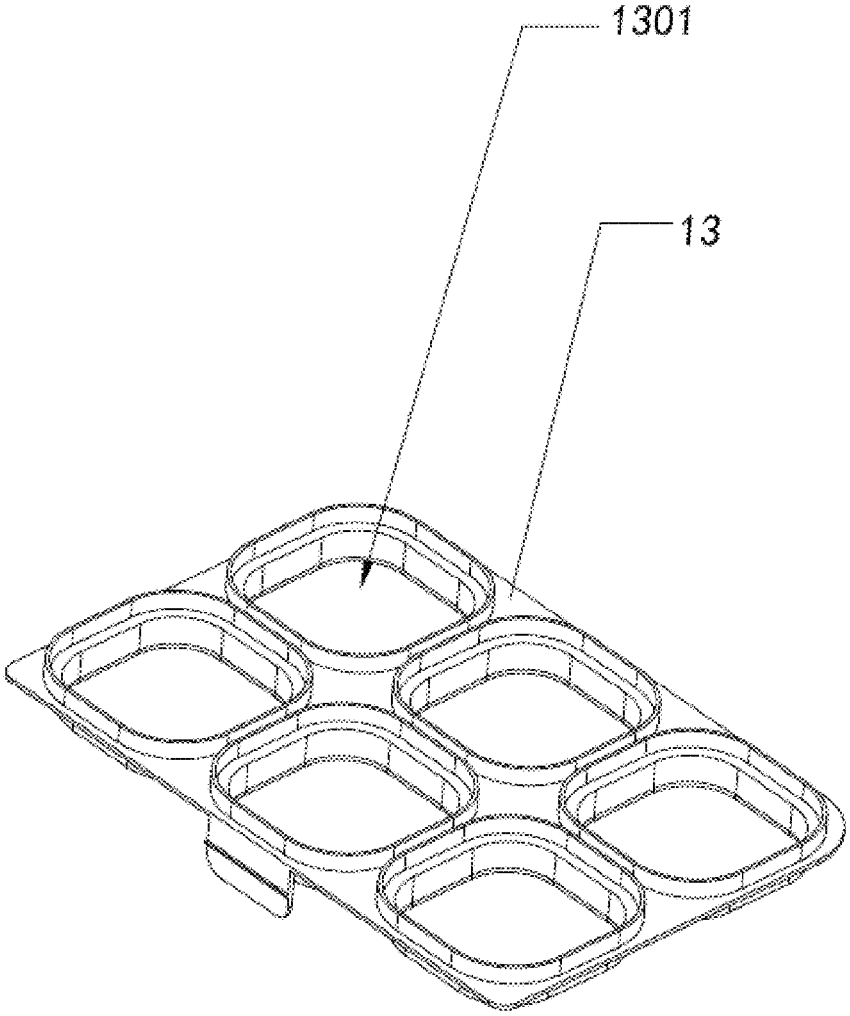
FIG. 8 shows a schematic structural diagram 1 of a placement plate.
Figure 9:
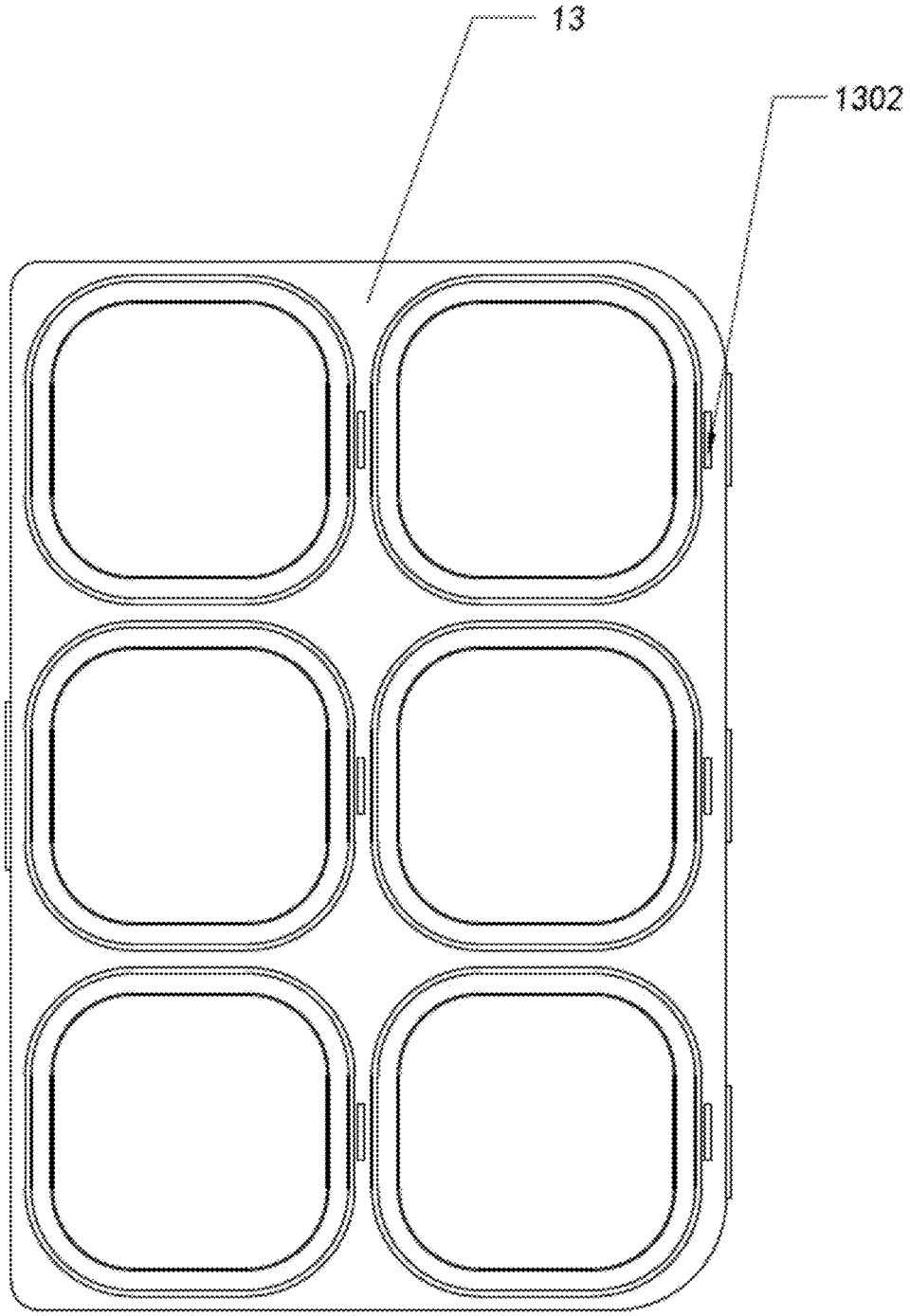
FIG. 9 shows a schematic structural diagram 2 of a placement plate.
Figure 10:
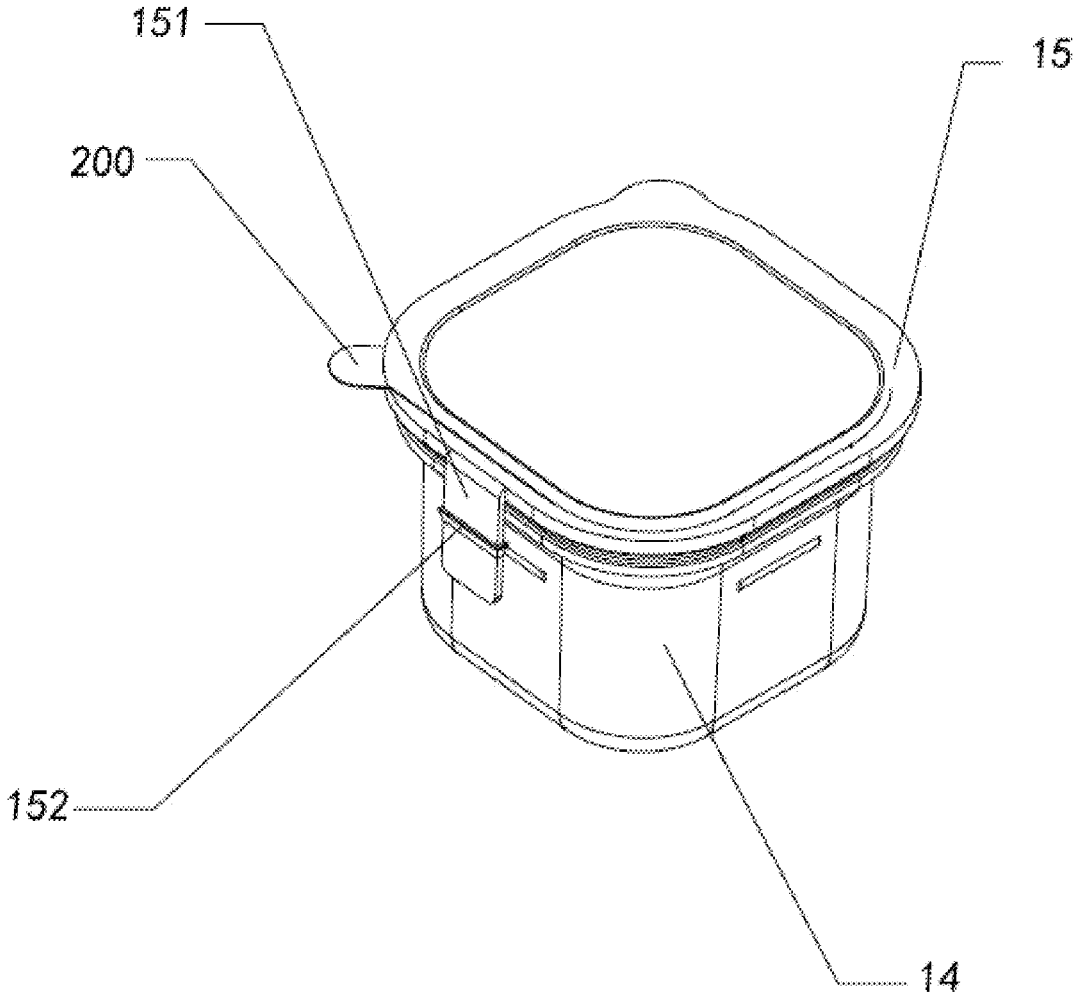
FIG. 10 shows a schematic structural diagram of a second housing.

It is worth noting that the second cavity is sealed by an aluminum film 200, so that the user can manually tear the aluminum film arranged on the second cavity. It should be further noted that one side, close to the bottom housing 11, of the cover plate 20 is further provided with a plurality of clamping blocks 23 arranged at intervals. Specifically, as shown in FIG. 6, the user can mate the at least one clay tool 300 with the corresponding clamping block 23, thereby defining a position of the clay tool 300. It should be further noted that the top of the cover plate 20 is further provided with a rotatable handle 400, so as to facilitate user handling.

In conclusion, based on the stacked clay box in the embodiments of this disclosure, it is illustrated that the stacked clay box provides advantages such as being able to store a variety of clays, being convenient to place the housing assembly, having a reasonable layout, and having high practicability.

It is worth noting that, in the embodiments of this disclosure, the stacked clay box is simple in structure, does not involve a complicated manufacturing process and an expensive material, and has high economy. Meanwhile, for manufacturers, the stacked clay box provided by this disclosure is easy to produce, low in cost, more beneficial to controlling the production costs, and further conducive to product popularization and use.

Those skilled in the art should understand that the foregoing description and the embodiments of this disclosure shown in the accompanying drawings are merely examples, but not to limit this disclosure. The object of the invention is fully and effectively achieved. The functions and structural principles of the present invention have been shown and described in the embodiments, and the embodiments of this disclosure may have any variations or modifications without departing from the principles.

What is claimed is:

1. A stacked clay box, comprising:

at least one housing assembly, wherein the housing assembly comprises a plurality of bottom housings, each of the plurality of bottom housings is provided with a first opening and a first cavity, the first opening is in communication with the first cavity, and the plurality of bottom housings are arranged to be stacked up and down;

and a cover plate, wherein the cover plate is arranged at the top of the bottom housing to close the first opening, the housing assembly further comprises two rotating plates, the two rotating plates are respectively located on two sides of the bottom housing, and one side of each of the rotating plates are rotatably connected to the bottom housing, so that the two rotating plates can swing in a direction towards the first opening, allowing the two rotating plates to be respectively further connected to two sides of the cover plate in a clamped manner.

2. The stacked clay box according to claim 1, wherein a bottom wall forming the first cavity is further provided with a partition plate, the partition plate separates the first cavity into two placement cavities, and the two placement cavities are both in communication with the first opening.

3. The stacked clay box according to claim 1, wherein one side of the bottom housing is provided with two first protruding portions arranged oppositely and a first clamping plate, the first clamping plate is located on a lower side farther from the first opening than the two first protruding portions, the other side of the bottom housing is provided with two second protruding portions arranged oppositely and a second clamping plate, the second clamping plate is located on a lower side farther from the first opening than the two second protruding portions, one side of the cover plate is provided with a third clamping plate, the other side of the cover plate is provided with a fourth clamping plate, the third clamping plate directly faces the first clamping plate, the fourth clamping plate directly faces the second clamping plate, the bottom of one of the rotating plates is rotatably connected to the two first protruding portions, the bottom of the other rotating plate is rotatably connected to the two second protruding portions, and the tops of the two rotating plates can swing in a direction towards the first opening, allowing the tops of the two rotating plates to be matched with the third clamping plate and the fourth clamping plate, respectively.

4. The stacked clay box according to claim 2, wherein a side wall forming the placement cavity is stepped, a placement plate is arranged in the placement cavity, the placement plate abuts against a step surface forming the placement cavity, the placement plate is further provided with a plurality of placement grooves which are distributed uniformly and arranged at intervals, and the placement grooves are in communication with the placement cavity.

5. The stacked clay box according to claim 4, wherein each of the placement grooves is provided with a second housing, the bottom of the second housing penetrates through the placement groove and is in contact with a bottom wall forming the placement groove, and meanwhile the top of the second housing is placed in the placement groove.

6. The stacked clay box according to claim 5, wherein the top of the second housing is provided with a cover body, the cover body is buckled at the top of the second housing, one side of the cover body is further provided with an extension end, a middle section of the extension end is provided with a clamping portion, the placement plate is further provided with a plurality of limiting grooves which are distributed uniformly and arranged at intervals, the plurality of limiting grooves are in one-to-one correspondence with the plurality of placement grooves, the extension end penetrates through the limiting groove, and meanwhile the clamping portion abuts against the bottom of the placement plate.

7. The stacked clay box according to claim 1, wherein one side, close to the bottom housing, of the cover plate is further provided with a plurality of clamping blocks arranged at intervals, and the plurality of clamping blocks are configured to clamp a clay tool.

* * * * *